US010345003B2

(12) United States Patent
Wong

(10) Patent No.: US 10,345,003 B2
(45) Date of Patent: Jul. 9, 2019

(54) SPLIT-TYPE AIR CONDITIONING AND HEAT PUMP SYSTEM WITH ENERGY EFFICIENT ARRANGEMENT

(71) Applicant: Lee Wa Wong, Pico Rivera, CA (US)

(72) Inventor: Lee Wa Wong, Pico Rivera, CA (US)

( * ) Notice: Subject to any disclaimer, the term of this patent is extended or adjusted under 35 U.S.C. 154(b) by 470 days.

(21) Appl. No.: 15/144,477

(22) Filed: May 2, 2016

(65) Prior Publication Data

US 2017/0314813 A1 Nov. 2, 2017

(51) Int. Cl.

| | |
|---|---|
| ***F24F 13/30*** | (2006.01) |
| ***F25B 13/00*** | (2006.01) |
| ***F25B 41/04*** | (2006.01) |
| ***F25B 41/06*** | (2006.01) |
| ***F25B 43/00*** | (2006.01) |
| ***F24F 1/0003*** | (2019.01) |

(52) U.S. Cl.

CPC ..... *F24F 13/30* (2013.01); *F24F 1/0003* (2013.01); *F25B 13/00* (2013.01); *F25B 41/04* (2013.01); *F25B 41/046* (2013.01); *F25B 41/062* (2013.01); *F25B 43/003* (2013.01); *F25B 2600/2515* (2013.01)

(58) Field of Classification Search

CPC ..... F24F 13/30; F24F 1/0003; F24F 1/0063; F24F 1/0007; F24F 1/0059; F25B 41/046; F25B 41/04; F25B 41/062; F25B 13/00; F25B 43/003; F25B 2600/2515; F25B 5/04

See application file for complete search history.

(56) References Cited

U.S. PATENT DOCUMENTS

| | | | | |
|---|---|---|---|---|
| 4,227,382 | A | 10/1980 | Coyne | |
| 4,554,796 | A | 11/1985 | Stankard | |
| 5,533,346 | A | 7/1996 | Freeman et al. | |
| 7,121,105 | B1 | 10/2006 | Rais | |
| 2012/0180505 | A1* | 7/2012 | Gerber | F25B 13/00 62/82 |
| 2016/0040895 | A1* | 2/2016 | Wong | F24F 3/06 165/218 |

FOREIGN PATENT DOCUMENTS

| | | | | |
|---|---|---|---|---|
| CN | 104833010 | B * | 6/2017 | F24F 1/06 |
| EP | 1321727 | A2 * | 6/2003 | F25B 13/00 |
| EP | 1801520 | A1 * | 6/2007 | F24F 3/153 |
| JP | 2006200869 | A * | 8/2006 | |

OTHER PUBLICATIONS

English translation of JP 2006200869 A.*

* cited by examiner

*Primary Examiner* — Edward F Landrum
*Assistant Examiner* — Melodee Jefferson
(74) *Attorney, Agent, or Firm* — Tsz Lung Yeung

(57) ABSTRACT

A split-type air conditioning and heat pump system an indoor unit, an outdoor unit and an energy efficient arrangement. The indoor unit includes an indoor housing having an indoor air inlet, and an indoor heat exchanger. The outdoor unit includes an outdoor housing, a compressor, an outdoor heat exchanger and a fan unit. The energy efficient arrangement includes an energy saving heat exchanger supported in the indoor housing and connected to the indoor heat exchanger and the outdoor heat exchanger. The energy saving heat exchanger is positioned between the indoor air inlet and the indoor heat exchanger so that air from an indoor space is arranged to pass through the energy saving heat exchanger before reaching the indoor heat exchanger.

19 Claims, 3 Drawing Sheets

SPLIT-TYPE AIR CONDITIONING AND HEAT PUMP SYSTEM WITH ENERGY EFFICIENT ARRANGEMENT

BACKGROUND OF THE PRESENT INVENTION

Field of Invention

The present invention relates to an air conditioning and heat pump system, and more particularly to a split-type air conditioning and heat pump system comprising an energy efficient arrangement.

Description of Related Arts

Referring to FIG. 1 of the drawings, a conventional split-type air conditioning and heat pump system is illustrated. The conventional split-type air conditioning and heat pump system comprises an outdoor unit 100P and an indoor unit 200P. The outdoor unit 100P usually comprises a compressor 101P, an outdoor heat exchanging unit 102P, a four-way valve 103P connected between the compressor 101P and the outdoor heat exchanging unit 102P, and an outdoor fan unit 107P. The split-type air conditioning and heat pump system further comprises a plurality of expansion valves 104P, a plurality of unidirectional valves 105P, and a plurality of filter devices 106P connected in parallel. An exemplary connection configuration is shown in FIG. 1 of the drawings. The four-way valve 103P has first through fourth connecting port 1031P, 1032P, 1033P, 1034P connected to different components of the outdoor unit 100P and the indoor unit 200P.

The indoor unit 200P usually comprises an indoor heat exchanging unit 201P. The indoor unit 200P and the outdoor unit 100P are connected through a plurality of connecting pipes and the various components described above. A predetermined amount of refrigerant is arranged to circulate between the indoor unit 200P and the outdoor unit 100P for performing heat exchange with ambient air and the air drawn from an indoor space.

A major disadvantage for the above-mentioned conventional split-type air conditioning and heat pump system is that its general Coefficient of Performance (C.O.P.) is very low. C.O.P. is generally recognized as the efficiency ratio of the amount of heating or cooling provided by the respective heating or cooling unit. This is unsatisfactory in view of rapidly increasing energy demand throughout the world.

SUMMARY OF THE PRESENT INVENTION

Certain variations of the present invention provide a split-type air conditioning and heat pump system comprising an energy efficient arrangement which may enhance a Coefficient of Performance (C.O.P.) of the entire system as compared to conventional split-type air conditioning and heat pump systems.

Certain variations of the present invention provide a split-type air conditioning and heat pump system comprising an energy efficient arrangement, wherein an energy saving heat exchanger may be provided on an indoor unit for pre-heating air drawn from indoor space.

Certain variations of the present invention provide a split-type air conditioning and heat pump system, comprising:

a plurality of connecting pipes;

an indoor unit comprising an indoor housing and an indoor heat exchanger supported in the indoor housing, the indoor housing having an indoor air inlet and an indoor air outlet;

an outdoor unit, which comprises:

an outdoor housing having an outdoor air inlet and an outdoor air outlet; and a compressor supported in the outdoor housing, the compressor having a compressor outlet and a compressor inlet;

an outdoor heat exchanger supported in the outdoor housing and connected to the compressor through at least one of the connecting pipes; and a fan unit supported in the outdoor housing for drawing air to flow between the outdoor air inlet and the outdoor air outlet; and an energy efficient arrangement, which comprises:

an energy saving heat exchanger supported in the indoor housing and connected to the indoor heat exchanger and the outdoor heat exchanger through the connecting pipes respectively, the energy saving heat exchanger being positioned between the indoor air inlet and the indoor heat exchanger so that air from an indoor space is arranged to pass through the energy saving heat exchanger before reaching the indoor heat exchanger;

the split-type air conditioning and heat pump system being selectively operated between an air conditioning mode and a heat pump mode, wherein in the air conditioning mode, a predetermined amount of vaporous refrigerant is arranged to leave the compressor and guided to enter the outdoor heat exchanger for releasing heat to ambient atmosphere, the refrigerant leaving the outdoor heat exchanger being guided to flow into the energy saving heat exchanger for absorbing heat from air drawn from the indoor space, the refrigerant leaving the energy saving heat exchanger being guided to flow into the indoor heat exchanger also for absorbing heat from the air drawn from the indoor space, the refrigerant leaving the indoor heat exchanger being guided to flow back to the compressor to complete an air conditioning cycle;

wherein in the heat pump mode, a predetermined amount of vaporous refrigerant is arranged to leave the compressor and guided to flow into the indoor heat exchanger for releasing heat to the indoor space, the refrigerant leaving the indoor heat exchanger being guided to flow into the energy saving heat exchanger for further releasing heat to the air to the indoor space, the refrigerant leaving the energy saving heat exchanger being guided to flow into the outdoor heat exchanger for absorbing heat from ambient air, the refrigerant leaving the outdoor heat exchanger being guided to flow to back the compressor to complete a heat pump cycle.

DETAILED DESCRIPTION OF THE PREFERRED EMBODIMENT

The following detailed description of the preferred embodiments are the preferred modes of carrying out the invention. The description is not to be taken in any limiting sense. It is presented for the purpose of illustrating the general principles of the present invention.

Figure 2:
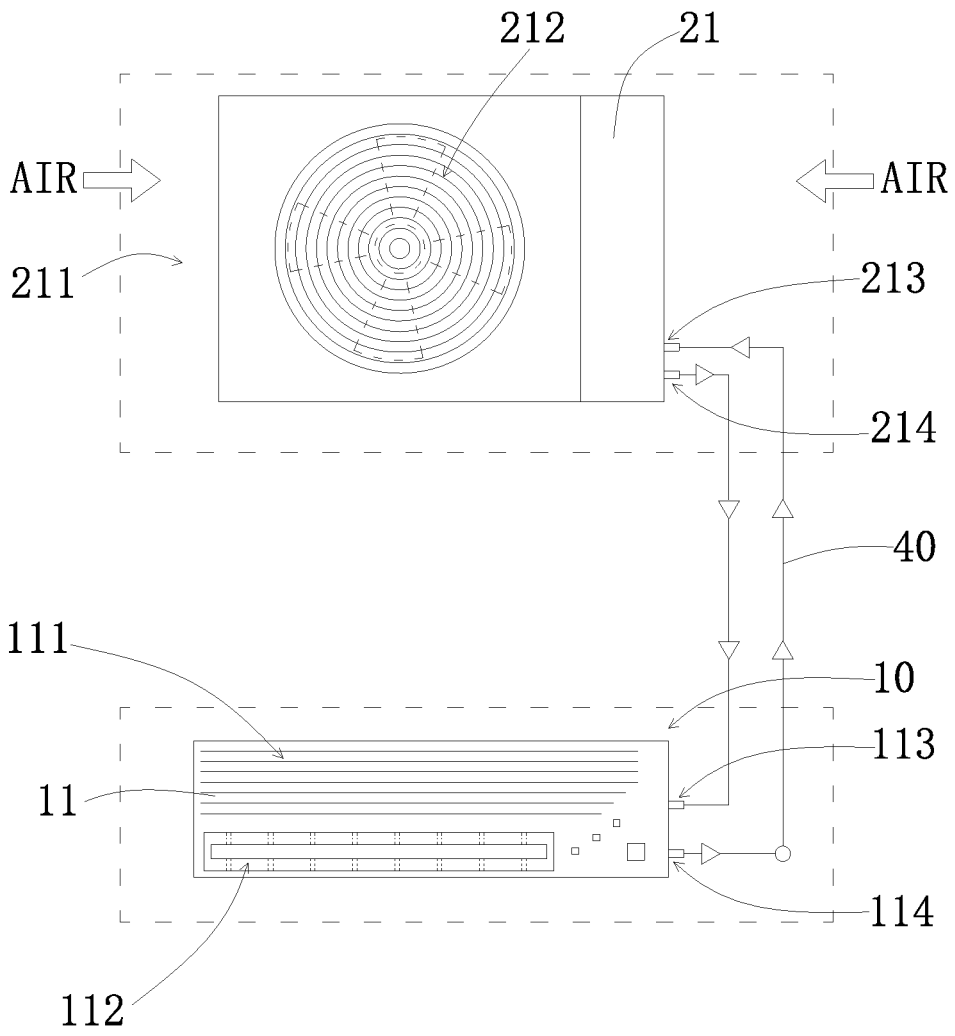
FIG. 2 is a schematic diagram of a split-type air conditioning and heat pump system according to a preferred embodiment of the present invention.
Figure 3:
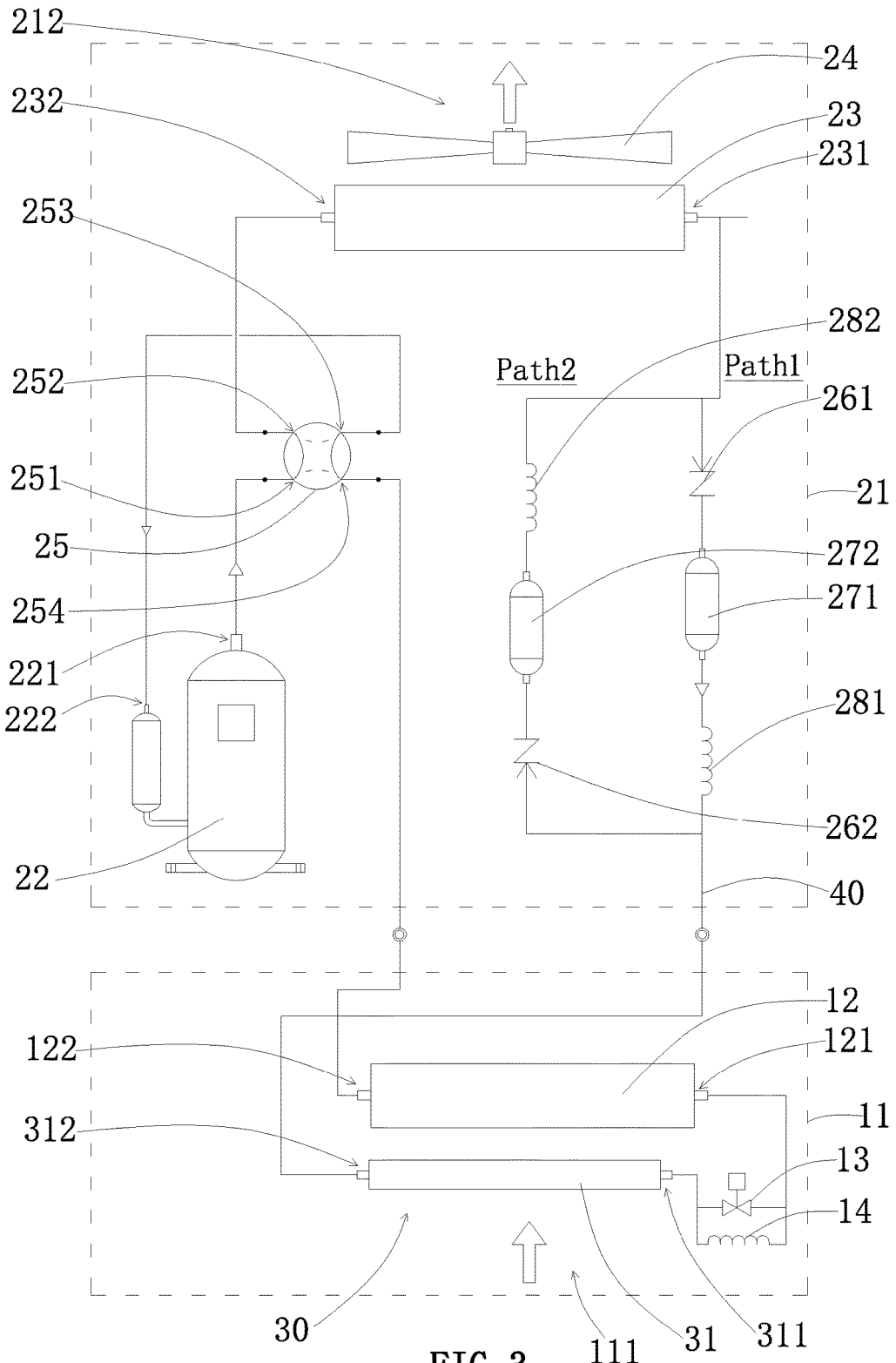
FIG. 3 is a schematic diagram of a split-type air conditioning and heat pump system according to a preferred embodiment of the present invention, illustrating a flowing path of refrigerant.

Referring to FIG. 2 to FIG. 3 of the drawings, a split-type air conditioning and heat pump system according to a preferred embodiment of the present invention is illustrated. Broadly, the split-type air conditioning and heat pump system may comprise an indoor unit 10, an outdoor unit 20, and an energy efficient arrangement 30. The split-type air conditioning and heat pump system utilizes a predetermined amount of working fluid, such as a predetermined amount of refrigerant, for carrying out heat exchange in various components of the system. The various components of the system may be connected through a plurality of connecting pipes 40. The split-type air conditioning and heat pump system of the present invention may be for heating or cooling a predetermined indoor space.

The indoor unit 10 may comprise an indoor housing 11 and an indoor heat exchanger 12 supported in the indoor housing 11. The indoor housing 11 may have an indoor air inlet 111 and an indoor air outlet 112. Moreover, the indoor housing 11 may have an indoor refrigerant inlet 113, and an indoor refrigerant indoor outlet 114.

The outdoor unit 20 may comprise an outdoor housing 21, a compressor 22, an outdoor heat exchanger 23, and a fan unit 24. The outdoor housing 21 may have an outdoor air inlet 211 and an outdoor air outlet 212. The compressor 22 may be supported in the outdoor housing 21, and may have a compressor outlet 221 and a compressor inlet 222. The outdoor housing 21 may further have an outdoor refrigerant inlet 213 connected to the indoor refrigerant outlet 114, and an outdoor refrigerant outlet 214 connected to the indoor refrigerant inlet 113 for facilitating flow of refrigerant between the indoor unit 10 and the outdoor unit 20.

The outdoor heat exchanger 23 may be supported in the outdoor housing 21 and connected to the compressor 22 through at least one of the connecting pipes 40. The fan unit 24 may be supported in the outdoor housing 21 for drawing air to flow between the outdoor air inlet 211 and the outdoor air outlet 212.

The energy efficient arrangement 30 may comprise an energy saving heat exchanger 31 supported in the indoor housing 11 of the indoor unit 10, and connected to the indoor heat exchanger 12 and the outdoor heat exchanger 23 through the connecting pipes 40 respectively. The energy saving heat exchanger 31 may be positioned between the indoor air inlet 111 and the indoor heat exchanger 12 so that air from an indoor space is arranged to pass through the energy saving heat exchanger 31 before reaching the indoor heat exchanger 12.

The split-type air conditioning and heat pump system may be selectively operated between an air conditioning mode and a heat pump mode. In the air conditioning mode, a predetermined amount of vaporous refrigerant is arranged to leave the compressor 22 and is guided to enter the outdoor heat exchanger 23 for releasing heat to ambient atmosphere. The refrigerant leaving the outdoor heat exchanger 23 may be guided to flow into the energy saving heat exchanger 31 for absorbing heat from air drawn from the indoor space. The refrigerant leaving the energy saving heat exchanger 31 may be guided to flow into the indoor heat exchanger 12 also for absorbing heat from the air drawn from the indoor space. The refrigerant leaving the indoor heat exchanger 12 may be guided to flow back to the compressor 22 to complete an air conditioning cycle.

When the split-type air conditioning and heat pump system is in the heat pump mode, a predetermined amount of vaporous refrigerant is arranged to leave the compressor 22 and guided to flow into the indoor heat exchanger 12 for releasing heat to the indoor space. The refrigerant leaving the indoor heat exchanger 12 may be guided to flow into the energy saving heat exchanger 31 for further releasing heat to the air to the indoor space. The refrigerant leaving the energy saving heat exchanger 31 may be guided to flow into the outdoor heat exchanger 23 for absorbing heat from ambient air. The refrigerant leaving the outdoor heat exchanger 23 may be guided to flow to back the compressor 22 to complete a heat pump cycle.

According to the preferred embodiment of the present invention, the indoor unit 10 may be positioned in an indoor space which is to be cooled or heated (such as a living room). Air from the indoor space may be drawn into the indoor unit 10 through the indoor air inlet 111, while cooled or heated air may be delivered to the indoor space through the indoor air outlet 112. The indoor air inlet 111 and the indoor air outlet 112 may be formed on a front side of the indoor housing 11.

On the other hand, the outdoor unit 20 may be positioned in an outdoor environment (such as outside a premises) for performing heat exchange with ambient air. The indoor unit 10 and the outdoor unit 20 may be connected through a plurality of connecting pipes 40.

The compressor 22 may be configured to pressurize the refrigerant flowing therethrough. It forms a starting point of refrigerant circulation for a typical air conditioning cycle or a heat pump cycle. The compressor 22 may be mounted in the outdoor housing 21.

The outdoor heat exchanger 23 may have a first passage port 231 and a second passage port 232, and may be configured to perform heat exchange between the refrigerant and ambient air drawn from the outdoor air inlet 211. The outdoor heat exchanger 23 may be configured to act as a condenser (i.e. converting the refrigerant into liquid state) when the split-type air conditioning and heat pump system is operated in the air conditioning mode. Conversely, the outdoor heat exchanger 23 may be configured to act as an evaporator (i.e. converting the refrigerant into gaseous or vaporous state) when the split-type air conditioning and heat pump system is operated in the heat pump mode. The first passage port 231 and the second passage port 232 may form as an inlet or outlet for the refrigerant passing through the outdoor heat exchanger 23. The outdoor heat exchanger 23 is connected between the compressor 22 and the energy saving heat exchanger 31 of the energy efficient arrangement 30.

The indoor heat exchanger 12 may have a first communicating port 121 and a second communicating port 122, and may be configured to perform heat exchange between the refrigerant and the air passing through the indoor heat exchanger 12. The indoor heat exchanger 12 may be configured to act as an evaporator (i.e. converting the refrigerant into gaseous or vaporous state) when the split-type air conditioning and heat pump system is operated in the air conditioning mode. Conversely, the indoor heat exchanger 12 may be configured to act as a condenser (i.e. converting the refrigerant into liquid state) when the split-type air conditioning and heat pump system is operated in the heat pump mode. The indoor heat exchanger 12 may be connected between the outdoor heat exchanger 23 and the energy saving heat exchanger 31 of the energy efficient arrangement 30.

The indoor heat exchanger 12 may extend along a transverse direction of the indoor housing 11 in a vicinity of the indoor air inlet 111. Air from the indoor space may be drawn into the indoor housing 11 and may be guided to sequentially pass through the energy saving heat exchanger 31 and the indoor heat exchanger 12 so as to carry out heat exchange with the refrigerant passing through the energy saving heat exchanger 31 and the indoor heat exchanger 12. The air having passed through the indoor heat exchanger 12 and the energy saving heat exchanger 31 may be guided to be re-delivered back to the indoor space through the indoor air outlet 112. The indoor air inlet 111 may be positioned above the indoor air outlet 112, as shown in FIG. 2 of the drawings.

The compressor 22, the indoor heat exchanger 12 and the outdoor heat exchanger 23 may be arranged and connected through the connecting pipes 40 in certain configurations. An exemplary configuration is shown in FIG. 3 of the drawings.

The split-type air conditioning and heat pump system may further comprise a switching device 25 connecting between the compressor 22, the outdoor heat exchanger 23, and the indoor heat exchanger 12 for altering a flowing path of the refrigerant. Specifically, the switching device 25 may have first through fourth connecting port 251, 252, 253, 254, and may be switched between an air conditioning switching mode and a heat pump switching mode, wherein in the air conditioning switching mode, the first connecting port 251 may be connected to the second connecting port 252 so that refrigerant may flow from the first connecting port 251 to the second connecting port 252, while the third connecting port 253 may be connected to the fourth connecting port 254 so that refrigerant may flow from the third first connecting port 253 to the fourth connecting port 254.

In the heat pump switching mode, the switching device 25 may be switched so that the first connecting port 251 may be connected to the fourth connecting port 254 so that refrigerant may flow from the first connecting port 251 to the fourth connecting port 254, while the second connecting port 252 may be connected to the third connecting port 253, so that refrigerant may flow from the second connecting port 252 to the third connecting port 253.

As shown in FIG. 3 of the drawings, the first connecting port 251 may be connected to the compressor outlet 221 of the compressor 22. The second connecting port 252 may be connected to the second passage port 232 of the outdoor heat exchanger 23. The third connecting port 253 may be connected to the compressor inlet 222 of the compressor 22. The fourth connecting port 254 may be connected to the second communicating port 122 of the indoor heat exchanger 12.

The first passage port 231 of the outdoor heat exchangers 23 may be connected to the second communicating port 122 of the indoor heat exchanger 12 through various components connected in parallel. An exemplary configuration is shown in FIG. 3 of the drawings. For the sake of clarity and ease of reading, the two parallel paths are designated path 1 and path 2 in FIG. 3. "Path" refers to the flowing path of the refrigerant.

The outdoor unit 20 may further comprise a first unidirectional valve 261 and a second unidirectional valve 262 which are received in the outdoor housing 21 and are connected in path 1 and path 2 respectively. The first and second unidirectional valve 261, 262 may be configured to restrict the flow of refrigerant in one predetermined direction, and not vice versa. In the preferred embodiment of the present invention, the first unidirectional valve 261 may be configured to allow the refrigerant to flow from the outdoor heat exchanger 23 toward the indoor heat exchanger 12 through path 1, and not vice versa. The second unidirectional valve 262 may be configured to allow the refrigerant to flow from the energy saving heat exchanger 31 toward the outdoor heat exchanger 23 through path 2, and not vice versa.

The outdoor unit 20 may further comprise a first filtering device 271 and a second filtering device 272 received in the outdoor housing 21 and connected in series to the first unidirectional valve 261 in path 1 and the second unidirectional valve 262 in path 2 respectively. The first filtering device 271 and the second filtering device 272 may be configured to filter unwanted substances from the refrigerant which pass through them.

The outdoor unit 20 may further comprise a first expansion valve 281 and a second expansion valve 282 connected in series to first filtering device 271 in path 1 and the second filtering device 272 in path 2 respectively. The first expansion valve 281 and the second expansion valve 282 may be configured to control and regulate the flow of the refrigerant which passes through them.

To summarize, the first unidirectional valve 261, the first filtering device 271 and the first expansion valve 281 are connected in series in path 1, while the second unidirectional valve 262, the second filtering device 272, and the second expansion valve 282 are connected in series in path 2. However, path 1 and path 2 are connected in parallel so that the components in each of path 1 and path 2 are connected in parallel with the components connected in other path.

As shown in FIG. 3 of the drawings, the energy saving heat exchanger 31 of the energy efficient arrangement 30 may have a first fluid port 311 and a second fluid port 312. The refrigerant may enter and leave the energy saving heat exchanger 31 through the first fluid port 311 and the second fluid port 312. The second fluid port 312 may be connected to the first passage port 231 of the outdoor heat exchanger 23 through either path 1 or path 2.

The indoor unit 10 may further comprise a two-way valve 13 and a flow regulator 14 connected in parallel, wherein the first fluid port 311 of the energy saving heat exchanger 31 may be connected to the first communicating port 121 of the indoor heat exchanger 12 through the two-way valve 13 and the flow regulator 14. The two-way valve 13 and the flow regulator 14 may be connected with each other in parallel. This configuration is shown in FIG. 3 of the drawings. The energy saving heat exchanger 31 may be configured as an evaporator when the split-type air conditioning and heat pump system is in the air conditioning mode. The energy saving heat exchanger 31 may be configured as a condenser when the split-type air conditioning and heat pump system is in the heat pump mode.

Moreover, the two-way valve 13 may be configured in such a manner that when the split-type air conditioning and heat pump system is in the air conditioning mode, the two-way valve 13 may be configured to allow refrigerant from passing therethrough (i.e. opened). Conversely, when the split-type air conditioning and heat pump system is in the heat pump mode, the two-way valve 13 may be configured to substantially prevent refrigerant from passing therethrough (i.e. closed). When the two-way valve 13 is opened, it may be configured to exert a very little resistance to liquid-gaseous refrigerant as compared to the flow resistance possessed by the flow regulator 14. When the two-way valve 13 is closed, it may be configured to exert a very large resistance to liquid-gaseous refrigerant when compared to that of the flow regulator 14.

The operation of the present invention may be described as follows: the split-type air conditioning and heat pump system described above involves a refrigerant flowing cycle which may flow through the above-mentioned components for carrying out several heat exchange processes.

When the split-type air conditioning and heat pump system is in the air conditioning mode, it is configured to generate cool air to the indoor space. A refrigerant cycle starts from the compressor 22. Superheated or vaporous refrigerant may be arranged to leave the compressor 22 through the compressor outlet 221. The switching device 25 may be switched to air conditioning switching mode. The refrigerant leaving the compressor 22 may pass through the first connecting port 251, the second connecting port 252, and enter the outdoor heat exchanger 23 through the second passage port 232. The refrigerant may then perform heat exchange with a coolant such as ambient air drawn from the outdoor air inlet 211 so as to release heat to ambient air. The ambient air may be discharged out of the outdoor housing 21 through the outdoor outlet 212. The refrigerant may be converted into liquid-gaseous state after releasing heat.

The refrigerant may then be guided to exit the outdoor heat exchanger 23 through the first passage port 231. The refrigerant leaving the outdoor heat exchanger 23 may be guided to flow through the first unidirectional valve 261, the first filtering device 271, and the first expansion valve 281 connected in path 1. The refrigerant may be prevented from entering path 2 by the second unidirectional valve 262 at this time. The refrigerant may then be guided to enter the energy saving heat exchanger 31 through the second fluid port 312 for absorbing heat from the air drawn from the indoor space. The refrigerant may then exit the energy saving heat exchanger 31 through the first fluid port 311. The refrigerant leaving the energy saving heat exchanger 31 may be guided to flow through the two-way valve 13 and the flow regulator 14. Since the two-way valve 13 is opened (as explained above), a majority of refrigerant may flow through the two-way valve 13 while only a very little amount of refrigerant may be allowed to flow through the flow regulator 14. The refrigerant passing through the two-way-valve 13 may be guided to flow into the indoor heat exchanger 12 through the first communicating port 121 for absorbing heat to the air drawn from the indoor space. The refrigerant may be converted back into vaporous or superheated state. The refrigerant may then be guided to leave the indoor heat exchanger 12 through the second communicating port 122. The refrigerant may then be guided to flow through the fourth connecting port 254 and the third connecting port 253 of the switching device 25 and eventually flow back to the compressor 22 through the compressor inlet 222. This completes one refrigerant cycle for the air conditioning mode.

In the air conditioning mode, the refrigerant may be guided to sequentially pass through the energy saving heat exchanger 31 and the indoor heat exchanger 12 for performing heat exchange with the air drawn from the indoor space. Following this route, the effective surface area for performing heat exchange is substantially increased because more heat exchangers are being utilized to air condition the indoor space; Moreover, the arrangement of the energy saving heat exchanger 31 connected in series with the indoor heat exchanger 12 also increases the temperature of the refrigerant such that the energy transfer of the system is constructively affected. The laws of thermodynamics include a basic thermodynamics principle that defines the study of a correlation between energy transfer and refrigerant temperature; more specifically, the energy loss of a compression refrigeration system, is reduced at increased temperature of the refrigerant. As applied to an air conditioning cycle of the split-type air conditioning and heat pump, this means that the higher the temperature of the refrigerant leaving the indoor unit 10, the lower the energy loss suffered by the compressor 22, thereby enhancing the energy efficiency of the system as compared to conventional split-type air conditioning and heat pump systems.

When the split-type air conditioning and heat pump system is in the heat pump mode, it is configured to generate heated air to the indoor space. A refrigerant cycle may also start from the compressor 22. Superheated or vaporous refrigerant may be arranged to leave the compressor 22 through the compressor outlet 221. The switching device 25 may be switched to heat pump switching mode. The refrigerant leaving the compressor 22 may pass through the first connecting port 251, the fourth connecting port 254, and enter the indoor heat exchanger 12 through the second communicating port 122. The refrigerant may then perform heat exchange with the air drawn from the indoor air inlet 111 so as to release heat to the air in the indoor space. The heated air may be discharged out of the indoor housing 11 through the indoor air outlet 112. The refrigerant may be converted into liquid state after releasing heat.

The refrigerant may then be guided to exit the indoor heat exchangers 12 through the first communicating port 121. The refrigerant leaving the indoor heat exchanger 12 may be guided to flow through the flow regulator 14 and enter the energy saving heat exchanger 31 through the first fluid port 311. When the split-type air conditioning and heat pump system is in the heat pump mode, the two-way valve 13 may be configured to be closed (as described above) so that refrigerant may not pass through the two-way valve 13. The refrigerant entering the energy saving heat exchanger 31 may perform heat exchange with the air drawn from the indoor space so as to pre-heat the air before it passes through the indoor heat exchanger 12. The refrigerant leaving the energy saving heat exchanger 31 may be guided to flow through the second unidirectional valve 262, the second filtering device 272, and the second expansion valve 282 connected in path 2. The refrigerant may be prevented from entering path 1 by the first unidirectional valve 261 at this time. The refrigerant may then be guided to enter the outdoor heat exchanger 23 through the first passage port 231 for absorbing heat from the air drawn from ambient atmosphere. The refrigerant may be converted back to vaporous state and then exit the outdoor heat exchanger 23 through the second passage port 232. The refrigerant may then be guided to flow through the second connecting port 252 and the third connecting port 253 of the switching device 25 and eventually flow back to the compressor 22 through the compressor inlet 222. This completes one refrigerant cycle for the heat pump mode.

In the heat pump mode, the refrigerant leaving the indoor heat exchanger 12 may be guided to enter the energy saving heat exchanger 31 for pre-heating the air drawn from the indoor space. The refrigerant may further be cooled down by the air from the indoor space. As a result, the air from the indoor space may undergo two heat exchange processes so that heat is absorbed from the refrigerant in both processes. Note that for these heat exchange processes, the work done by the compressor 22 remains unchanged as compared to conventional heat pump cycle as shown in FIG. 1 of the drawings, while more heat are produced to the indoor space.

Figure 1:
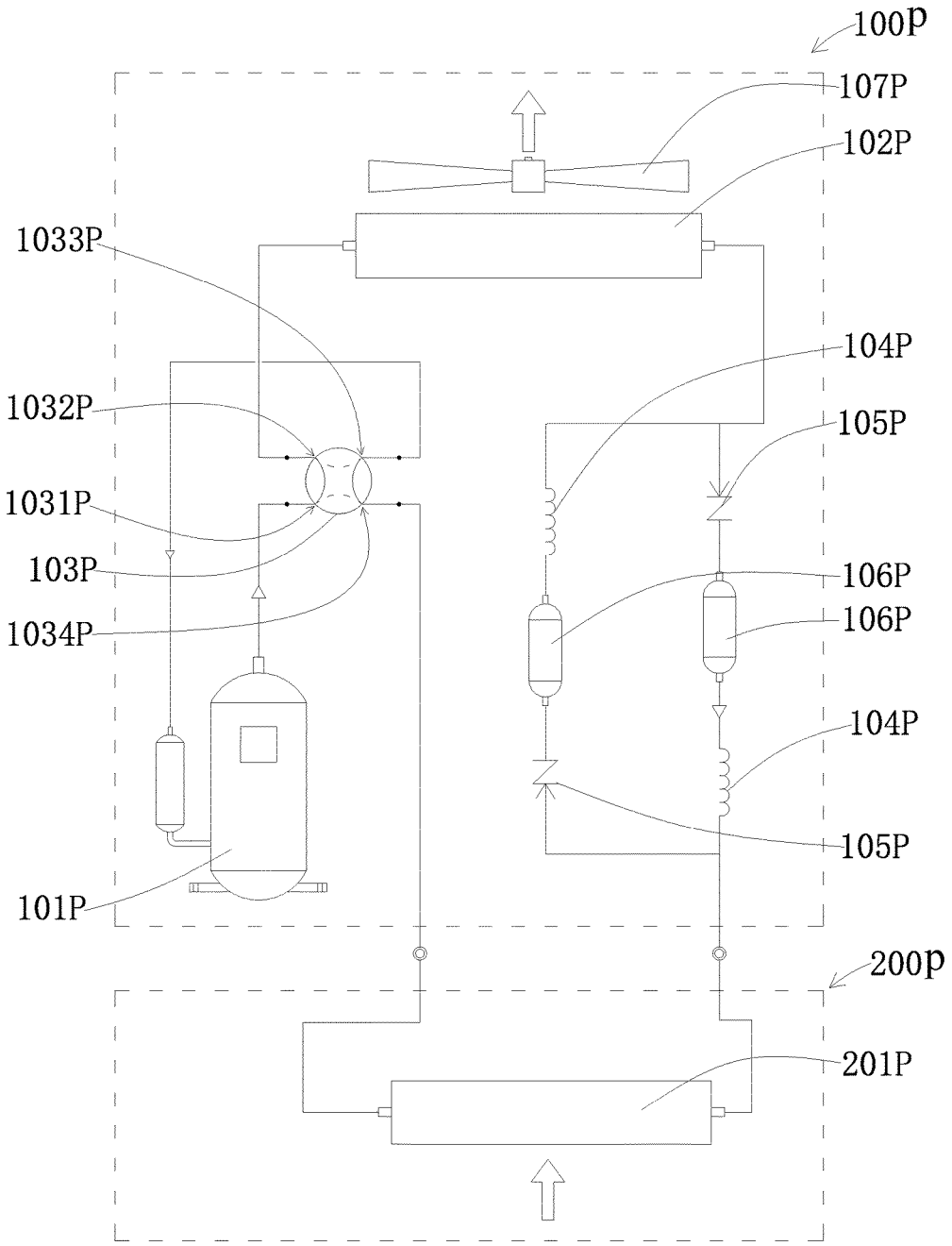
FIG. 1 PRIOR ART
FIG. 1 is a conventional split-type air conditioning and heat pump system.

On the other hand, the temperature of the refrigerant reaching the outdoor heat exchanger 23 is higher than that of the conventional heat pump cycle shown in FIG. 1 of the drawings. This increases the efficiency of the heat exchange process between the refrigerant and the ambient air.

The present invention, while illustrated and described in terms of a preferred embodiment and several alternatives, is not limited to the particular description contained in this specification. Additional alternative or equivalent components could also be used to practice the present invention.

What is claimed is:

1. A split-type air conditioning and heat pump system, comprising:

a plurality of connecting pipes;

an indoor unit comprising an indoor housing and an indoor heat exchanger supported in said indoor housing, said indoor housing having an indoor air inlet and an indoor air outlet;

an outdoor unit, which comprises:

an outdoor housing having an outdoor air inlet and an outdoor air outlet; and a compressor supported in said outdoor housing, said compressor having a compressor outlet and a compressor inlet;

an outdoor heat exchanger supported in said outdoor housing and connected to said compressor through at least one of said plurality of connecting pipes; and a fan supported in said outdoor housing for drawing air to flow between said outdoor air inlet and said outdoor air outlet; and an energy efficient arrangement, which comprises:

an energy saving heat exchanger supported in said indoor housing and connected to said indoor heat exchanger and said outdoor heat exchanger through said plurality of connecting pipes respectively, said energy saving heat exchanger being positioned between said indoor air inlet and said indoor heat exchanger so that air from an indoor space is arranged to pass through said energy saving heat exchanger before reaching said indoor heat exchanger, said split-type air conditioning and heat pump system being selectively operated between an air conditioning mode and a heat pump mode, wherein in said air conditioning mode, said energy saving heat exchanger is configured as an evaporator, vaporous refrigerant is arranged to leave said compressor and guided to enter said outdoor heat exchanger for releasing heat to ambient atmosphere, said refrigerant leaving said outdoor heat exchanger being guided to flow into said energy saving heat exchanger for absorbing heat from air drawn from said indoor space, said refrigerant leaving said energy saving heat exchanger being guided to flow into said indoor heat exchanger also for absorbing heat from said air drawn from said indoor space, said refrigerant leaving said indoor heat exchanger being guided to flow back to said compressor to complete an air conditioning cycle, wherein in said heat pump mode, said energy saving heat exchanger is configured as a condenser, vaporous refrigerant is arranged to leave said compressor and guided to flow into said indoor heat exchanger for releasing heat to said indoor space, said refrigerant leaving said indoor heat exchanger being guided to flow into said energy saving heat exchanger for further releasing heat to said air to said indoor space, said refrigerant leaving said energy saving heat exchanger being guided to flow into said outdoor heat exchanger for absorbing heat from ambient air, said refrigerant leaving said outdoor heat exchanger being guided to flow to back said compressor to complete a heat pump cycle.

2. The split-type air conditioning and heat pump system, as recited in claim 1, wherein said outdoor heat exchanger has a first passage port and a second passage port, said outdoor heat exchanger being configured to be a condenser when said split-type air conditioning and heat pump system is operated in said air conditioning mode, and to be an evaporator when said split-type air conditioning and heat pump system is operated in said heat pump mode.

3. The split-type air conditioning and heat pump system, as recited in claim 2, wherein said indoor heat exchanger has a first communicating port and a second communicating port, said indoor heat exchanger being configured as an evaporator when said split-type air conditioning and heat pump system is operated in said air conditioning mode, and as a condenser when said split-type air conditioning and heat pump system is operated in said heat pump mode.

4. The split-type air conditioning and heat pump system, as recited in claim 3, wherein said energy saving heat exchanger of said energy efficient arrangement has a first fluid port connected to said first communicating port of said indoor heat exchanger through at least one of said plurality of connecting pipes, and a second fluid port connected to said first passage port of said outdoor heat exchanger through at least one of said plurality of connecting pipes.

5. The split-type air conditioning and heat pump system, as recited in claim 4, wherein said indoor unit further comprises a two-way valve and a flow regulator connected in parallel, said first fluid port of said energy saving heat exchanger being connected to said first communicating port of said indoor heat exchanger through said two-way valve and said flow regulator.

6. The split-type air conditioning and heat pump system, as recited in claim 5, wherein said two-way valve is configured in such a manner that when said split-type air conditioning and heat pump system is in said air conditioning mode, said two-way valve is arranged to allow refrigerant from passing therethrough, and when said split-type air conditioning and heat pump system is in said heat pump mode, said two-way valve is arranged to prevent refrigerant from passing therethrough.

7. The split-type air conditioning and heat pump system, as recited in claim 6, further comprising a switching device connecting between said compressor, said outdoor heat exchanger, and said indoor heat exchanger, said switching device having a first through fourth connecting port, and being configured to be switched between an air conditioning switching mode and a heat pump switching mode, wherein in said air conditioning switching mode, said switching device is switched such that said first connecting port is connected to said second connecting port, while said third connecting port is connected to said fourth connecting port, wherein in said heat pump switching mode, said switching device is switched such that said first connecting port is connected to said fourth connecting port, while said second connecting port is connected to said third connecting port.

8. The split-type air conditioning and heat pump system, as recited in claim 7, wherein said first connecting port is connected to said compressor outlet of said compressor through at least one of said plurality of connecting pipes.

9. The split-type air conditioning and heat pump system, as recited in claim 8, wherein said second connecting port is connected to said second passage port of said outdoor heat exchanger through at least one of said plurality of connecting pipes.

10. The split-type air conditioning and heat pump system, as recited in claim 9, wherein said third connecting port is connected to said compressor inlet of said compressor through at least one of said plurality of connecting pipes.

11. The split-type air conditioning and heat pump system, as recited in claim 10, wherein said fourth connecting port is connected to said second communicating port of said indoor heat exchanger through at least one of said plurality of connecting pipes.

12. The split-type air conditioning and heat pump system, as recited in claim 11, wherein said outdoor unit further comprises a first unidirectional valve and a second unidirectional valve received in said outdoor housing and are connected between said first passage port of said outdoor heat exchanger and said second fluid port of said energy saving heat exchanger, said first unidirectional valve and said second unidirectional valve being connected in parallel with each other, each of said first unidirectional valve and said second unidirectional valve being configured to restrict a flow of said refrigerant in one predetermined direction, and not vice versa.

13. The split-type air conditioning and heat pump system, as recited in claim 12, wherein said outdoor unit further comprises a first filter and a second filter received in said outdoor housing and connected in series to said first unidirectional valve and said second unidirectional valve respectively.

14. The split-type air conditioning and heat pump system, as recited in claim 13, wherein said outdoor unit further comprises a first expansion valve and a second expansion valve connected in series to said first filter and said second filter respectively, said first expansion valve and said second expansion valve being configured to control and regulate a flow of said refrigerant passing therethrough.

15. The split-type air conditioning and heat pump system, as recited in claim 7, wherein in said air conditioning mode, said refrigerant is guided to sequentially flow through said compressor, said first connecting port of said switching device, said second connecting port of said switching device, said outdoor heat exchanger for releasing heat to ambient air, said energy saving heat exchanger of said energy efficient arrangement for absorbing heat from said indoor space, said two-way valve, said indoor heat exchanger also for absorbing heat from said indoor space, said fourth connecting port of said switching device, said third connecting port of said switching device, and back to said compressor.

16. The split-type air conditioning and heat pump system, as recited in claim 14, wherein in said air conditioning mode, said refrigerant is guided to sequentially flow through said compressor, said first connecting port of said switching device, said second connecting port of said switching device, said outdoor heat exchanger for releasing heat to ambient air, said first unidirectional valve, said first filter, and said first expansion valve, said energy saving heat exchanger of said energy efficient arrangement for absorbing heat from said indoor space, said two-way valve, said indoor heat exchanger also for absorbing heat from said indoor space, said fourth connecting port of said switching device, said third connecting port of said switching device, and back to said compressor.

17. The split-type air conditioning and heat pump system, as recited in claim 7, wherein in said heat pump mode, said refrigerant is guided to sequentially flow through said compressor, said first connecting port of said switching device, said fourth connecting port of said switching device, said indoor heat exchanger for releasing heat to said indoor space, said flow regulator, said energy saving heat exchanger for pre-heating said air from said indoor space, said outdoor heat exchanger for absorbing heat from ambient atmosphere, said second connecting port of said switching device, said third connecting port of said switching device, and back to said compressor.

18. The split-type air conditioning and heat pump system, as recited in claim 15, wherein in said heat pump mode, said refrigerant is guided to sequentially flow through said compressor, said first connecting port of said switching device, said fourth connecting port of said switching device, said indoor heat exchanger for releasing heat to said indoor space, said flow regulator, said energy saving heat exchanger for pre-heating said air from said indoor space, said outdoor heat exchanger for absorbing heat from ambient atmosphere, said second connecting port of said switching device, said third connecting port of said switching device, and back to said compressor.

19. The split-type air conditioning and heat pump system, as recited in claim 16, wherein in said heat pump mode, said refrigerant is guided to sequentially flow through said compressor, said first connecting port of said switching device, said fourth connecting port of said switching device, said indoor heat exchanger for releasing heat to said indoor space, said flow regulator, said energy saving heat exchanger for pre-heating said air from said indoor space, said second unidirectional valve, said second filter, said second expansion valve, said outdoor heat exchanger for absorbing heat from ambient atmosphere, said second connecting port of said switching device, said third connecting port of said switching device, and back to said compressor.

* * * * *